US009816276B2

(12) United States Patent
Noble

(10) Patent No.: US 9,816,276 B2
(45) Date of Patent: Nov. 14, 2017

(54) SYSTEM AND METHOD FOR ADJUSTING ALIGNMENT OF A PANEL

(71) Applicant: Angus Noble, Bodmin (GB)

(72) Inventor: Angus Noble, Bodmin (GB)

( * ) Notice: Subject to any disclaimer, the term of this patent is extended or adjusted under 35 U.S.C. 154(b) by 0 days.

(21) Appl. No.: 14/745,459

(22) Filed: Jun. 21, 2015

(65) Prior Publication Data

US 2016/0265232 A1 Sep. 15, 2016

(30) Foreign Application Priority Data

Mar. 9, 2015 (GB) ..... 1503931.6

(51) Int. Cl.
*E04F 11/18* (2006.01)

(52) U.S. Cl.
CPC ..... *E04F 11/1812* (2013.01); *E04F 11/1834* (2013.01); *E04F 11/1851* (2013.01); *E04F 11/1853* (2013.01)

(58) Field of Classification Search
CPC ..... E04F 11/1812; E04F 11/1817; E04F 11/1834; E04F 11/1851; E04F 11/1853
USPC ..... 52/126.3, 126.4, 126.7, 832, 766, 238.1, 52/800.12, 800.14, 800.16, 204.65, 52/745.05
See application file for complete search history.

(56) References Cited

U.S. PATENT DOCUMENTS 4,054,268 A * 10/1977 Sher ..... E04F 11/1851 256/24
4,690,264 A * 9/1987 Adrian ..... B66B 23/22 198/335
4,920,717 A 5/1990 Hooper, Jr.
5,156,251 A * 10/1992 Johnson ..... B66B 23/22 198/335
5,284,237 A * 2/1994 Mello ..... B66B 23/22 198/335

(Continued)

FOREIGN PATENT DOCUMENTS

AT EP 1647663 A1 * 4/2006 ..... E06B 3/5454
AT EP 2597220 A1 * 5/2013 ..... E04F 11/1812

(Continued)

OTHER PUBLICATIONS

Machine translation of Foreign reference EP 2597220 A1, obtained from https://patentscope.wipo.int/search/en/detail.jsf?docId=EP78645858&recNum=1&maxRec=&office=&prevFilter=&sortOption=&queryString=&tab=PCTDescription (last visited on Dec. 15, 2016).*

*Primary Examiner* — Theodore Adamos
(74) *Attorney, Agent, or Firm* — Crose Law LLC; Bradley D. Crose

(57) ABSTRACT

It is known for balustrades and partitions to be formed from a flat panel, such as glass, and for such panels to be anchored along a lower edge and substantially unsupported at an upper edge. Vertical alignment of such panels has been achieved by ensuring that the trough in which they are anchored is itself precisely aligned on a horizontal, such that any flat panel inserted therein stands in a vertical plane. According to the invention, a panel may be aligned with its major face in a substantially vertical plane, even when the trough is located with its base substantially not horizontal. In addition, the panel may be held in the base of the trough by the force of an adjustment part on a first joint surface, thereby increasing stability of the panel.

9 Claims, 7 Drawing Sheets

(56) References Cited

U.S. PATENT DOCUMENTS

| | | | | | |
|---|---|---|---|---|---|
| 5,458,220 | A * | 10/1995 | Nguyen | B66B 23/22 | 198/335 |
| 6,434,905 | B1 * | 8/2002 | Sprague | E06B 3/02 | 49/501 |
| 9,193,569 | B2 * | 11/2015 | Shimizu | B66B 23/22 | |
| 2010/0307082 | A1 * | 12/2010 | Nash | E04F 11/1851 | 52/238.1 |
| 2013/0036680 | A1 * | 2/2013 | Noble | E04F 11/1851 | 52/126.4 |
| 2015/0197959 | A1 * | 7/2015 | Tinwala | E04H 17/16 | 256/24 |
| 2015/0240851 | A1 * | 8/2015 | Giacometti | F16B 9/023 | 403/374.3 |
| 2015/0267415 | A1 * | 9/2015 | Zhou | E04F 11/1853 | 52/208 |

FOREIGN PATENT DOCUMENTS

| | | | | |
|---|---|---|---|---|
| CA | 2849839 | | 12/2014 | |
| DE | 102009008307 | A1 | 10/2009 | |
| EP | 1647663 | A1 | 4/2006 | |
| EP | 1700990 | A1 | 9/2006 | |
| EP | 2112296 | A1 | 10/2009 | |
| FR | 2930270 | A1 | 4/2008 | |
| IT | WO 2013121330 | A2 * | 8/2013 | E04F 11/1853 |
| JP | WO 2013140504 | A1 * | 9/2013 | B66B 23/22 |
| WO | 2009017873 | A1 | 2/2009 | |
| WO | 2011095779 | A2 | 8/2011 | |

* cited by examiner

SYSTEM AND METHOD FOR ADJUSTING ALIGNMENT OF A PANEL

FIELD OF THE INVENTION

The present invention relates generally to an apparatus, system and a method for adjusting an alignment of a panel, and finds particular although not exclusive utility in adjustment of glass panels used on balustrades and partitions.

BACKGROUND OF THE INVENTION

It is known for balustrades and partitions to be formed from a flat panel, such as glass, and for such panels to be anchored along a lower edge and substantially unsupported at an upper edge. Known methods of supporting these panels include placing a lower edge into a trough and clamping the panel in place.

It is desirable for these panels to be arranged/aligned vertically, both for aesthetic reasons, and to ensure that their centre of mass acts through their footprint, thereby reducing constant torque on their support mechanisms. Conventionally, this has been achieved by ensuring that the trough is itself precisely aligned on a horizontal, such that any flat panel inserted therein stands in a vertical plane.

International Patent Application WO2011/095779 describes an alternative mechanism for supporting a flat panel in a vertical alignment, whereby the angle of the panel can be adjusted after insertion. Thus, WO2011/095779 allows a trough to be placed on an approximately horizontal surface, or a surface that may be subject to subsidence, and for alignment of a panel to be achieved at a later point.

However, the arrangement of WO2011/095779 is difficult to adjust, due to adjustment components (such as a hexagonal nut head) being located within the trough itself, and at an inconvenient angle. For example, a user of WO2011/095779 would only be able to use a short spanner/wrench to adjust the hexagonal nut head, and then only by turning it through perhaps 100 degrees at most, and more likely only 30 degrees.

BRIEF SUMMARY OF THE INVENTION

The present invention seeks to overcome this problem by providing an easily adjustable system for adjusting the alignment of a flat panel, which also has the advantages of providing secure support, and post-construction alignment.

According to a first aspect of the present invention, there is provided a system for adjusting alignment of a flat panel, the system comprising: a longitudinal trough having two opposing side walls and a base connected therebetween, the trough being open on a side opposing the base, the trough configured to be attachable to a surface; at least one gripping part for securely holding a section of the flat panel, the at least one gripping part having a contact surface for engaging with a face of the flat panel and a first joint surface inclined obliquely to the contact surface, the at least one gripping part locatable within the longitudinal trough with the joint surface at least partially facing the open side of the trough opposing the base; and at least one adjustment part connected at a fixed end to one of the side walls of the trough, the at least one adjustment part having a second joint surface spaced from the fixed end of the adjustment part by a distance that is adjustable by a user, the second joint surface arrangable in contact with the first joint surface to form a joint; and wherein reducing the distance between the second joint surface and the fixed end of the adjustment part results in: a force being applied by the second joint surface onto the first joint surface, resulting in the gripping part gripping the panel and urging the panel toward the base of the trough; and pivoting of the panel within the trough about an axis parallel to a longitudinal length of the trough.

In this way, a panel may be aligned with its major face in a substantially vertical plane, even when the trough is located with its base substantially not horizontal. In particular, up to 10 degrees from horizontal, more particularly up to 5 degrees from horizontal, for instance up to 3 degrees from horizontal.

In addition, the force acting on the panel may have a component acting perpendicular to a major face of the panel (which acts to grip the panel) and another component acting substantially parallel to the major face of the panel (which urges the panel toward the base of the trough); that is, the panel may be held in the base of the trough by the force of the adjustment part on the first joint surface, thereby increasing stability of the panel.

Furthermore, adjustment of the panel may be made more simply than in prior art methods by means of the adjustment part being more accessible to a user.

The system may be configured such that, when in use, the adjustment part is under tension, and the gripping part may be under compression. The system may be configured such that, when in use, the adjustment part is not under compression. In this way, access to one end of the adjustment part may be easily provided for adjustment; that is, the side wall and the second joint surface each pull in opposing directions on the adjustment member, toward a middle of the adjustment member. In contrast, were the adjustment part under compression when in use, each end of the adjustment member would be obscured by parts of the system providing the compression; that is, the side wall would push on the first end of the adjustment member and an opposing end of the adjustment member would push on the gripping part.

The present invention may be usable with flat panels that have two opposing major faces, joined around a perimeter by for instance four or more minor faces. The major faces may define the plane of the panel, and the minor faces may define an edge of the panel. The major faces are substantially larger than the minor faces. The present invention may be usable with one or more shims and/or spacers located with a flat panel, for instance, against a major face of the flat panel. In particular, a shim/spacer may be placed between the flat panel and the gripping part, such that the gripping part may be used with flat panels having differing thicknesses. Alternatively or additionally, the gripping part may be adjustable for use with flat panels having different thicknesses. In some embodiments, the gripping part may comprise one or more of such shims/spacers. Each shim/spacer may be a flat sheet, which in some circumstances may be tapered or wedged, but is preferably of substantially uniform thickness. The shim/spacer may be made of metal, aluminium, silicone, rubber, synthetic rubber, wood, plastic material, composite material or any other suitable material. The shim/spacer may be approximately 1 mm, 2 mm, 2.5 mm, 3 mm, 4 mm or 5 mm thick (i.e. between major faces). A single or multiple shims/spaces may be used adjacent to a flat panel.

The trough may have a longitudinal axis, and may be substantially longer in a length parallel to the longitudinal axis than in a width or depth at right angles to the longitudinal axis. The side walls may extend along respective sides of the trough, parallel to the longitudinal axis. Similarly, the base may extend between the side walls, also substantially parallel to the longitudinal axis. Ends of the trough may be open or closed; that is, the ends substantially perpendicular to the side walls, the base and the longitudinal axis. The trough may be open on a side substantially opposing the base; that is, the side walls may be connected to one another at the base, and optionally the ends, but not at substantially any additional point. The open side opposing the base may be referred to as the top, even when the trough is located on a surface that is substantially non-horizontal, or is affixed to a surface at a non-zero angle to the base of the trough. The side walls may be spaced from one another. The trough may be integrally formed, formed by extrusion, moulding, or may be assembled from component parts, for instance by welding, bolting, screwing, gluing, etc. The trough may be a channel.

The trough may have a tapered cross-section; that is an internal width of the trough adjacent to the base may be less than an internal width of the trough adjacent to the open top. In particular, an internal width of the trough approximately mid-way up may be more than an internal width of the trough adjacent to the base. The gripping part may be configured to be wedgeable into the trough substantially adjacent to the base.

The trough may be configured to be removably or substantially permanently attachable to a surface. The trough may be configured to be set into a trench in a surface, such that the open side of the trough is substantially level with the surface. The trough may be attached to a surface such that it is horizontal; however, the present invention is capable of use when the trough is attached to a surface such that it is substantially non-horizontal. The trough may be screwed, glued, cemented, bolted or otherwise fixed to and/or into a surface.

The gripping part may securely hold a periphery of a flat panel, for instance a portion of the flat panel adjacent to a lower edge of the panel. The gripping part may engage a face of the flat panel immediately to a lower edge of the panel.

The gripping part may comprise a relatively high-friction surface for securely holding a section of the flat panel. The gripping part may comprise rubber material, synthetic rubber material, silicone rubber material and/or any other suitable form of resilient material. The contact surface may be substantially planar and/or flat. The contact surface may be substantially smooth; however, in preferred embodiments the contact surface is textured. For instance, the contact surface may comprise ridges, protuberances and/or dimples.

The first joint surface may be substantially non-parallel to the contact surface. The first joint surface may be substantially non-perpendicular to the contact surface. The first joint surface may be at an angle of between 20 and 70 degrees to the contact surface, and this angle may be measured about an axis that is substantially parallel to the longitudinal length of the trough. The angle may be between 30 and 60 degrees, in particular between 35 and 55 degrees, more particularly between 40 and 50 degrees, for example, approximately 40, 45 or 50 degrees.

The first and/or second joint surface may be a relatively low-friction surface; that is, the first and/or second joint surfaces may have a substantially lower friction than the contact surface.

In use, the joint surface may be facing upwards, and/or may be seen through the open side of the trough opposing the base (e.g. seen through the top of the trough).

The term 'connected' in relation to the adjustment part and the side walls is to be interpreted as substantially more than mere contact of the parts together. The adjustment part may be secured to the side wall, for instance by a cooperating engaging mechanism. The adjustment part may be removably or substantially permanently connected to the side wall of the trough. The adjustment part may be connected to the side walls by cooperating hooking parts, screw-threading parts, or by other suitable connection parts. The adjustment part may be integrally formed with the side walls, or may be glued, welded, or similarly affixed to the side wall. The adjustment part may be slidably received in a slot in the side wall, for instance by sliding in a direction substantially perpendicular to a direction in which the second joint surface is movable toward/away from the fixed end.

The distance between the second joint surface and the fixed end of the adjustment part may be configured to be adjusted with a screw-thread arrangement. For instance, the adjustment part may comprise a threaded shank and a cooperatively threaded nut may be provided on the shank such that rotation of the nut about the shank results in movement of the second joint surface along the shank. For example, the second joint surface may be provided on a sliding part having a central bore through which the threaded shank passes, and a nut may limit movement of the sliding part along the shank.

The adjustment part may comprises: an externally threaded shank having a head; a sliding part arranged to be slidably receivable on the threaded shank, the sliding part comprising the second joint surface arranged to face at least partially toward the fixed end of the adjustment part; and/or an internally threaded nut; and the sliding part may be biased away from the fixed end by the first joint surface, and relative rotation of the nut and the head about an axis of the shank may cause movement of the sliding part with respect to the fixed end.

The head may be located at the fixed end such that rotation of the nut moves the sliding part along the threaded shank.

The nut may be located at the fixed end such that rotation of the head moves the sliding part with the head in relation to the fixed end.

In this way, a portion of the threaded shank between the head and the nut is under tension.

The second joint surface may be arrangable in mere contact with the first joint surface to form a joint. The second joint surface may not be connected to the first joint surface by any means other than mere contact. The second joint surface may be arranged in contact with the first joint surface to form a planar joint; that is, a joint with one rotational and two translational degrees of freedom. The first joint surface and/or the second joint surface may be further constrained such that the first and second joint surfaces may move with respect to each other substantially only in one translational degree of freedom. The first and/or second joint surface may be substantially flat; however, in some embodiments, the first and/or second joint surfaces may be substantially curved, such that relative movement between the two joint surfaces corresponds to relative rotation about a common axis. The joint may operate as a revolute, pin or hinge joint.

The system may comprise at least one pair of opposed gripping parts for securely holding a section of the flat panel, and may comprise at least one pair of adjustment parts, each adjustment part comprising a respective second joint surface arrangable in contact with a respective first joint surface of one of the pair of gripping parts, to form a respective joint, wherein reducing the distance between the second joint surface and the fixed end of one of the pair of adjustment parts, and/or increasing the distance between the second joint surface and the fixed end of the other of the pair of adjustment parts, may result in pivoting of the panel within the trough about an axis parallel to a longitudinal length of the trough. The system may comprise a plurality of pairs of opposed gripping parts spaced along the trough.

The opposed gripping parts may comprise a single gripping part extending around the panel. Alternatively or additionally, a series of gripping parts on one side of a panel may comprise a single gripping part. Similarly, a series of adjustment parts (and or components thereof) may comprise a single adjustment part (and/or a component thereof).

According to a second aspect of the present invention, there is provided an apparatus for use in the system of the first aspect, the apparatus comprising: at least one gripping part for securely holding a section of a flat panel, the at least one gripping part having a contact surface for engaging with a face of the flat panel and a first joint surface inclined obliquely to the contact surface, the at least one gripping part locatable within the longitudinal trough with the joint surface at least partially facing an open side of a trough; and at least one adjustment part connectable at a fixed end to a side wall of the trough, the at least one adjustment part having a second joint surface spaced from the fixed end of the adjustment part by a distance that is adjustable by a user, the second joint surface arrangable in contact with the first joint surface to form a joint; and wherein reducing the distance between the second joint surface and the fixed end of the adjustment part results in: a force being applied by the second joint surface onto the first joint surface, resulting in the gripping part gripping the panel and urging the panel toward the base of the trough; and pivoting of the panel within the trough about an axis parallel to a longitudinal length of the trough.

According to a second aspect of the present invention, there is provided a balustrade comprising: a substantially flat panel; a longitudinal trough having two opposing side walls and a base connected therebetween, the trough being open on a side opposing the base, the trough configured to be attachable to a surface; at least one gripping part arranged to securely hold a section of the flat panel, the at least one gripping part having a contact surface engaged with a face of the flat panel and a first joint surface inclined obliquely to the contact surface, the at least one gripping part located within the longitudinal trough with the joint surface at least partially facing the open side of the trough opposing the base; and at least one adjustment part connected at a fixed end to one of the side walls of the trough, the at least one adjustment part having a second joint surface spaced from the fixed end of the adjustment part by a distance that is adjustable by a user, the second joint surface arranged in contact with the first joint surface to form a joint; and wherein reducing the distance between the second joint surface and the fixed end of the adjustment part results in: a force being applied by the second joint surface onto the first joint surface, resulting in the gripping part gripping the panel and urging the panel toward the base of the trough; and pivoting of the panel within the trough about an axis parallel to a longitudinal length of the trough.

According to a second aspect of the present invention, there is provided a method of adjusting alignment of a flat panel, the method comprising: providing a flat panel; providing a system according to the first aspect; attaching the trough to a surface; engaging the contact surface of the gripping part with a face of the flat panel; securely holding a section of the flat panel with the gripping part; locating the gripping part within the longitudinal trough with the joint surface at least partially facing the open side of the trough opposing the base; connecting at least one adjustment part at its fixed end to one of the side walls of the trough; arranging the second joint surface in contact with the first joint surface to form a joint; reducing the distance between the second joint surface and the fixed end of the adjustment part; applying a force being with the second joint surface onto the first joint surface; gripping the panel with the gripping part; urging the panel with the gripping part toward the base of the trough; and pivoting of the panel within the trough about an axis parallel to a longitudinal length of the trough.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
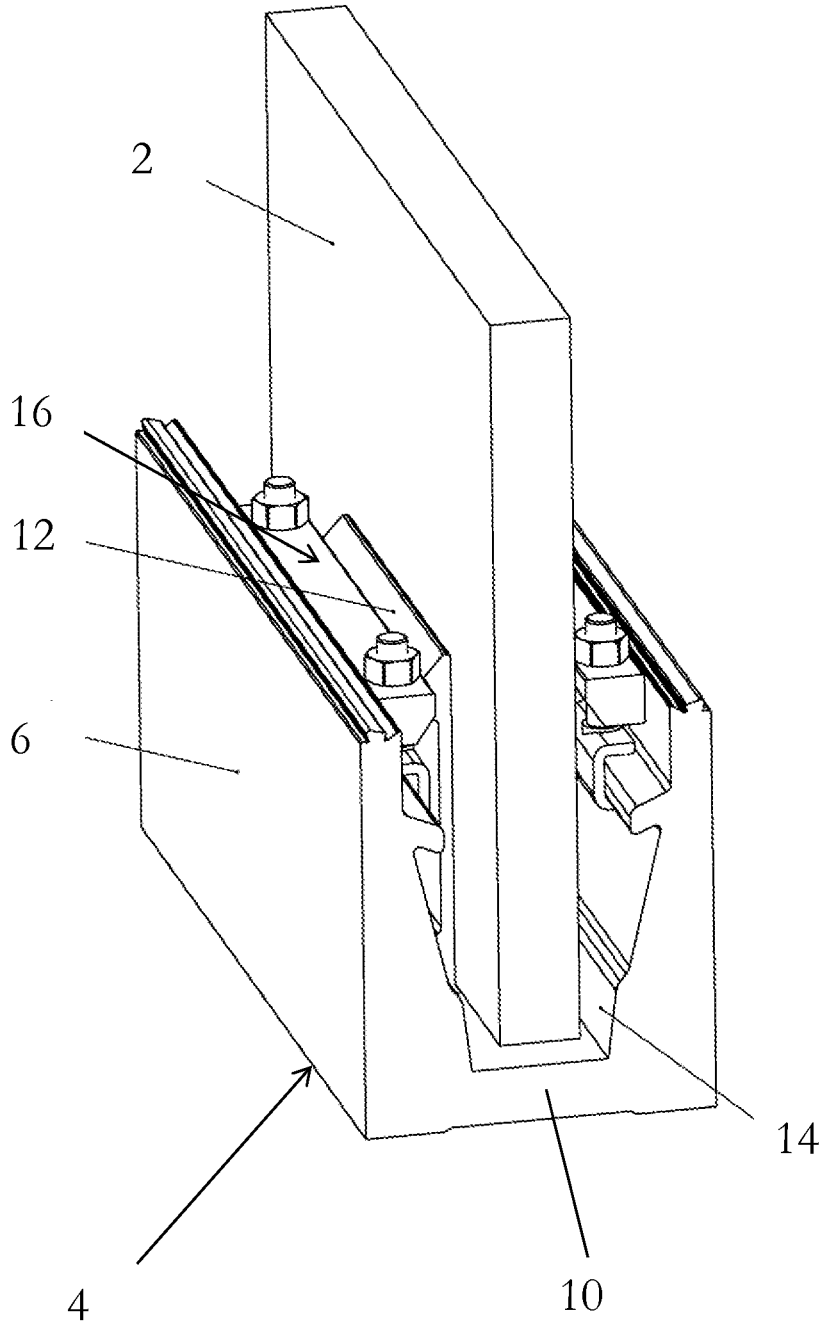
FIG. 1 shows a perspective view of a first arrangement.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 shows a perspective view of a first arrangement in which a panel 2 is supported in a trough 4 having side walls 6 and a base 10. A portion of the lower edge of the panel is gripped by gripping parts 12, which are urged together and into a tapering slot 14 in the base of the trough 4 by adjustment mechanisms 16.

Figure 2:
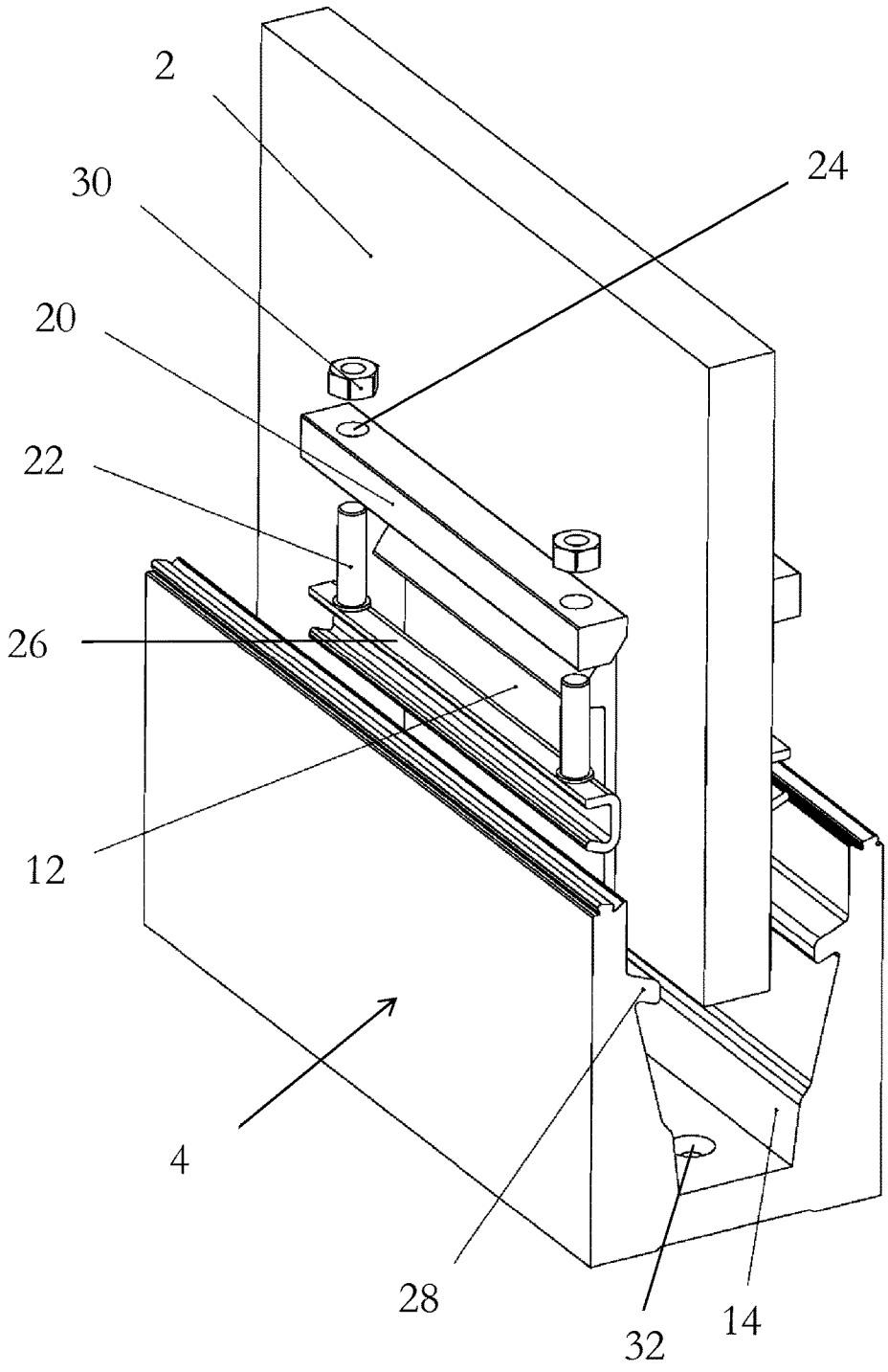
FIG. 2 shows an exploded view of the first arrangement.

FIG. 2 shows an exploded view of the first arrangement and, in particular, the detail of the adjustment mechanism 16. A block 20 is received on two threaded shafts 22, such that it may slide thereon via through holes 24 in the block 20. Lower ends of the threaded shafts 22 are connected to an elongate hook 26 that is configured to cooperate with projection 28 on an interior of the side wall 6. Nuts 30 on an upper end of the threaded shafts 22 maintain the block 20 thereon. A hole 32 is provided in the base of the trough for securing the trough to a surface.

Figure 3:
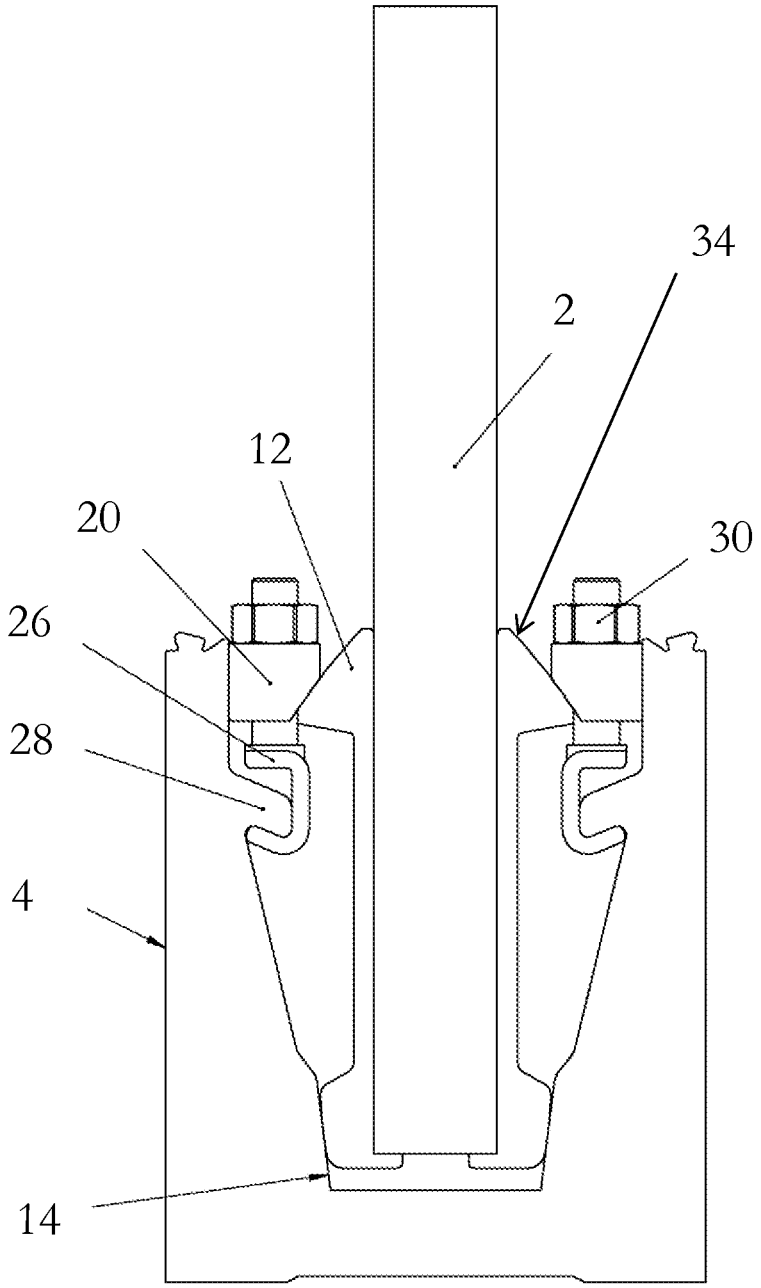
FIG. 3 shows an end view of the first arrangement in a first configuration.

FIG. 3 shows an end view of the first arrangement in a first configuration; that is, with the trough 4 located on a horizontal surface (not shown) such that the panel 2 is disposed symmetrically within the trough 4 and vertical. The nuts 30 have been tightened equally such that both blocks 20 push against the surfaces 34 of the gripping parts 12. The blocks 20 are held against the surfaces 34 by the elongate hooks 26 pulling on the projections 28. The force through the surfaces 34 acts to push the panel 2 down into the tapering slot 14, and to clamp the panel from either side adjacent to the open top of the trough. As can be seen from the figure, the nuts 30 remain exposed above the open top of the trough for ease of manipulation. In particular, a user may be able to rotate a spanner/wrench by more than 180 degrees in a single turn of the nut 30.

Figure 4:
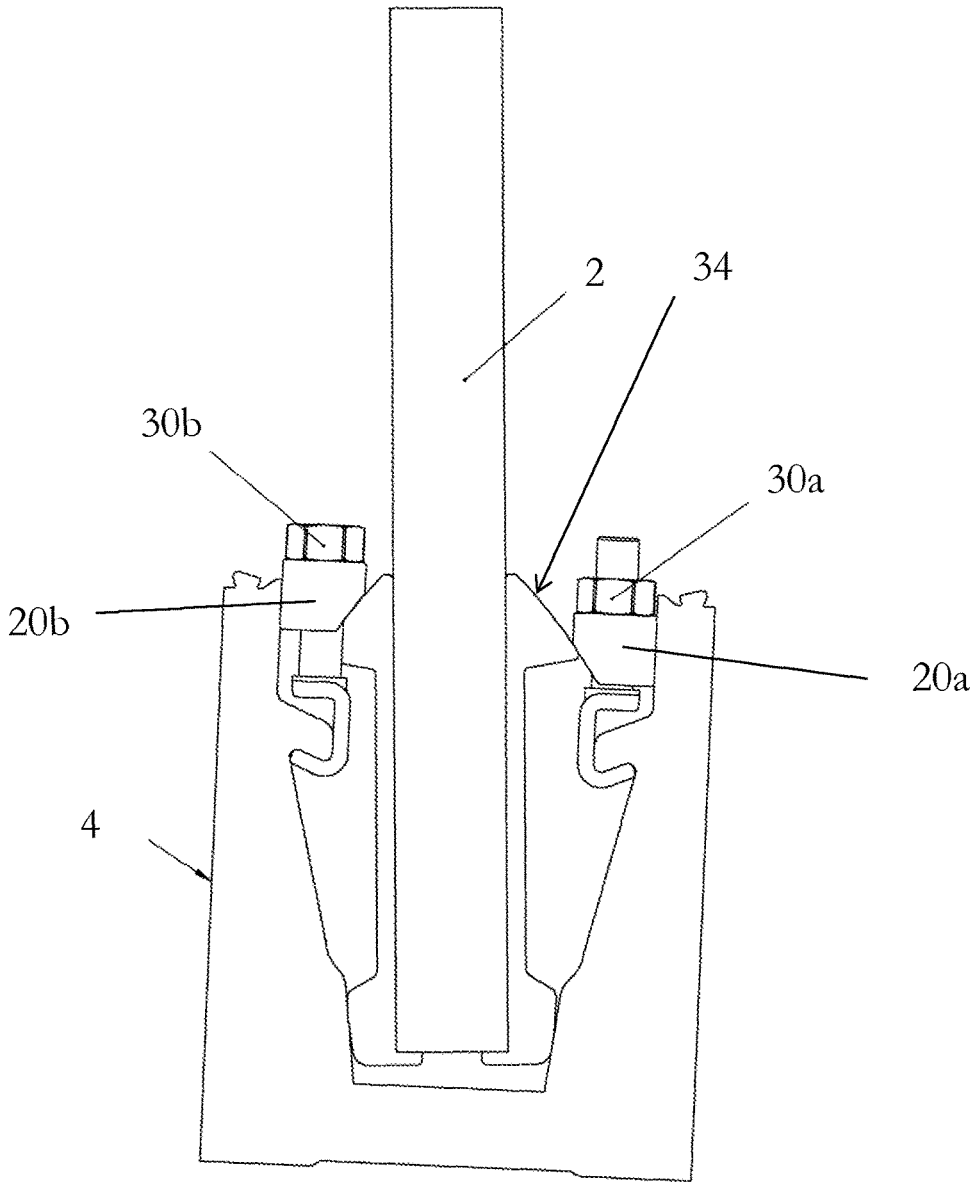
FIG. 4 shows an end view of the first arrangement in a second configuration.

FIG. 4 shows an end view of the first arrangement in a second configuration; that is, with the trough 4 located on a substantially non-horizontal surface (not shown) such that asymmetric adjustment of the adjustment mechanisms 16 is required in order to align the panel 2 vertically.

The nut on the right hand side 30*a* has been tightened more than the nut on the left hand side 30*b*, such that the block on the right hand side 20*a* is lower than the block on the left hand side 20*b*. This asymmetric distribution of the blocks 20 results in an asymmetric positioning of the surfaces 34 against which the blocks 20 push.

Figure 5:
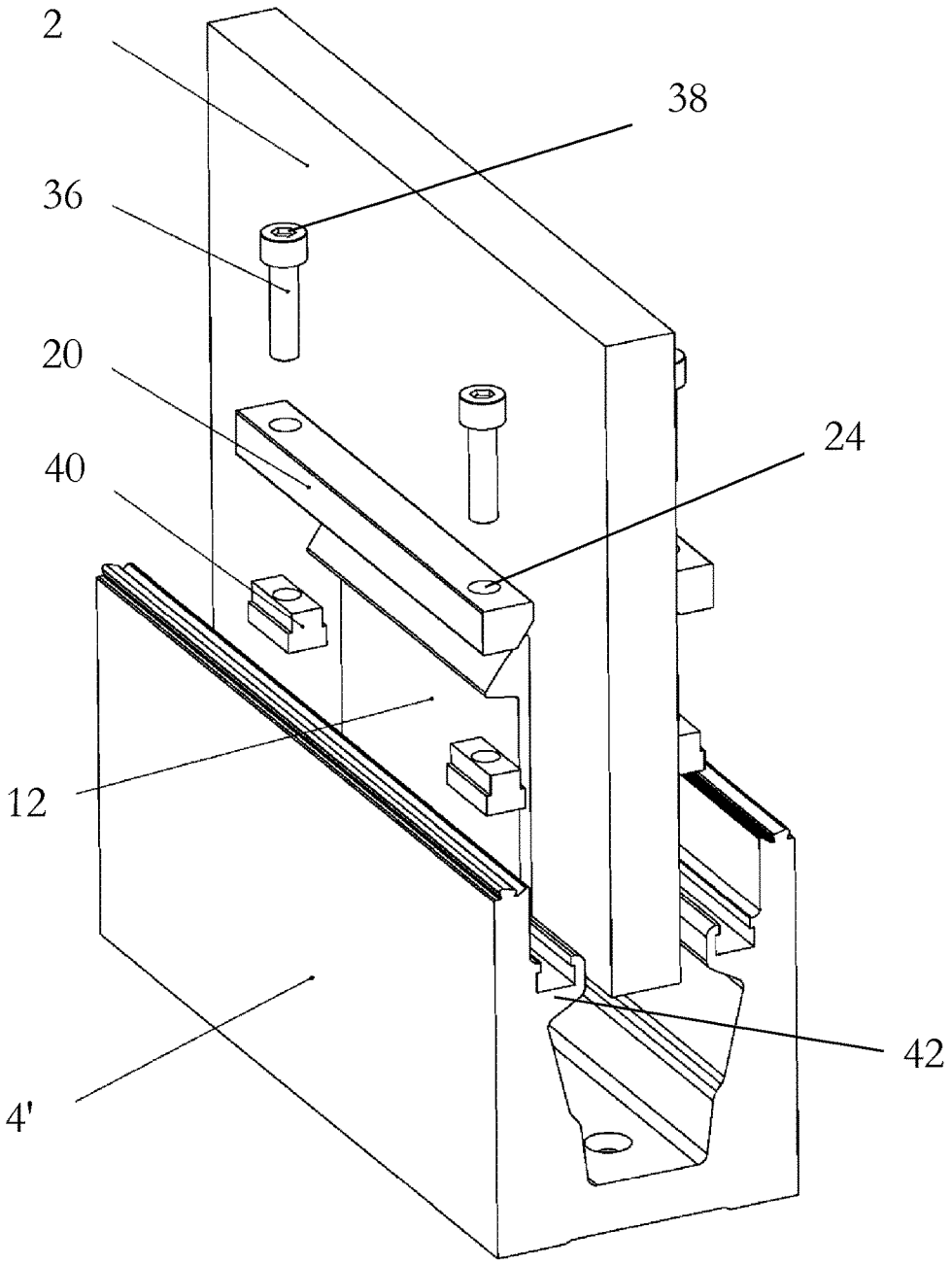
FIG. 5 shows an exploded view of a second arrangement.

FIG. 5 shows an exploded view of a second arrangement in which the configuration of the adjustment mechanisms 16 differs, and an alternative trough 4' is required. In this arrangement, the blocks 20 are disposed on threaded shafts 36 that have a head including a screw drive socket 38 (shown as an Allen or Hex socket; however, other forms of screw drive are contemplated). The threaded shafts 36 pass through the through holes 24 in the blocks 20 as before, and engage with t-slot nuts that sit within a t-slot track 42.

Figure 6:
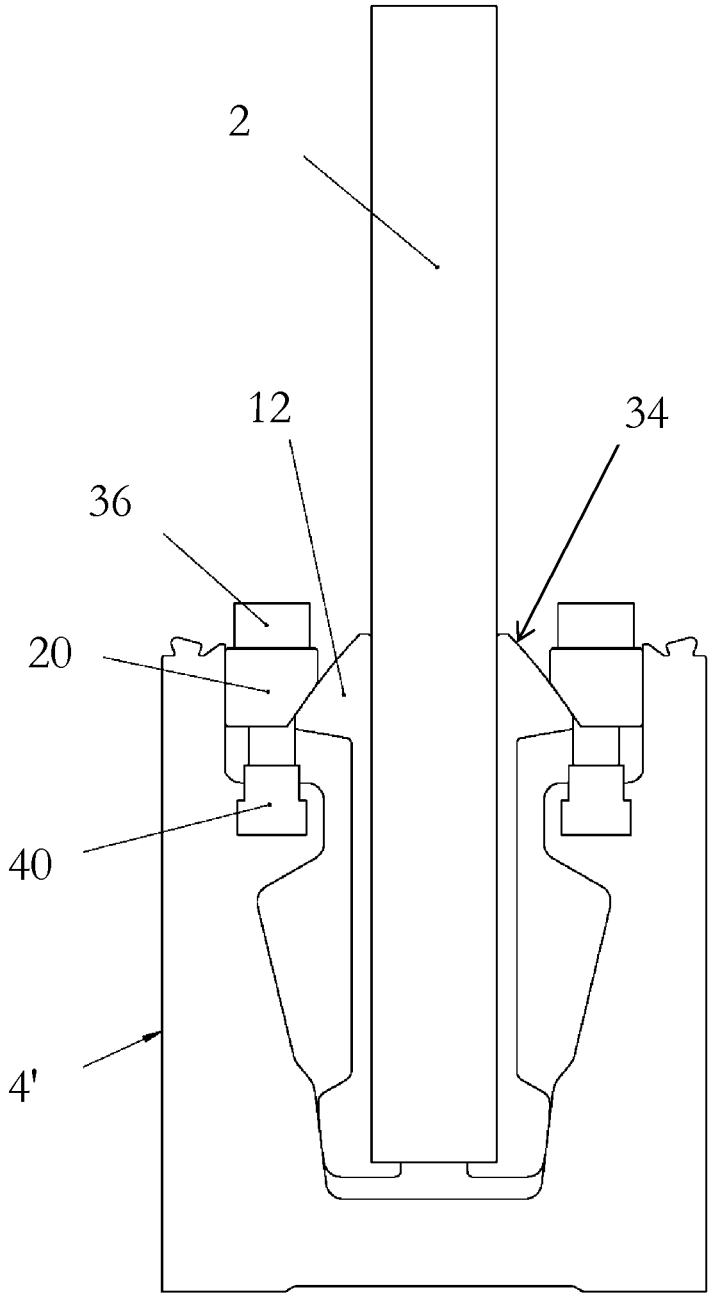
FIG. 6 shows an end view of the second arrangement in a first configuration.

FIG. 6 shows an end view of the second arrangement in a first configuration; that is, with the trough 4' located on a horizontal surface (not shown) such that the panel 2 is disposed symmetrically within the trough 4' and vertical. The threaded shafts 36 have been tightened into the t-slot nuts 40 equally such that both blocks 20 push against the surfaces 34 of the gripping parts 12.

Figure 7:
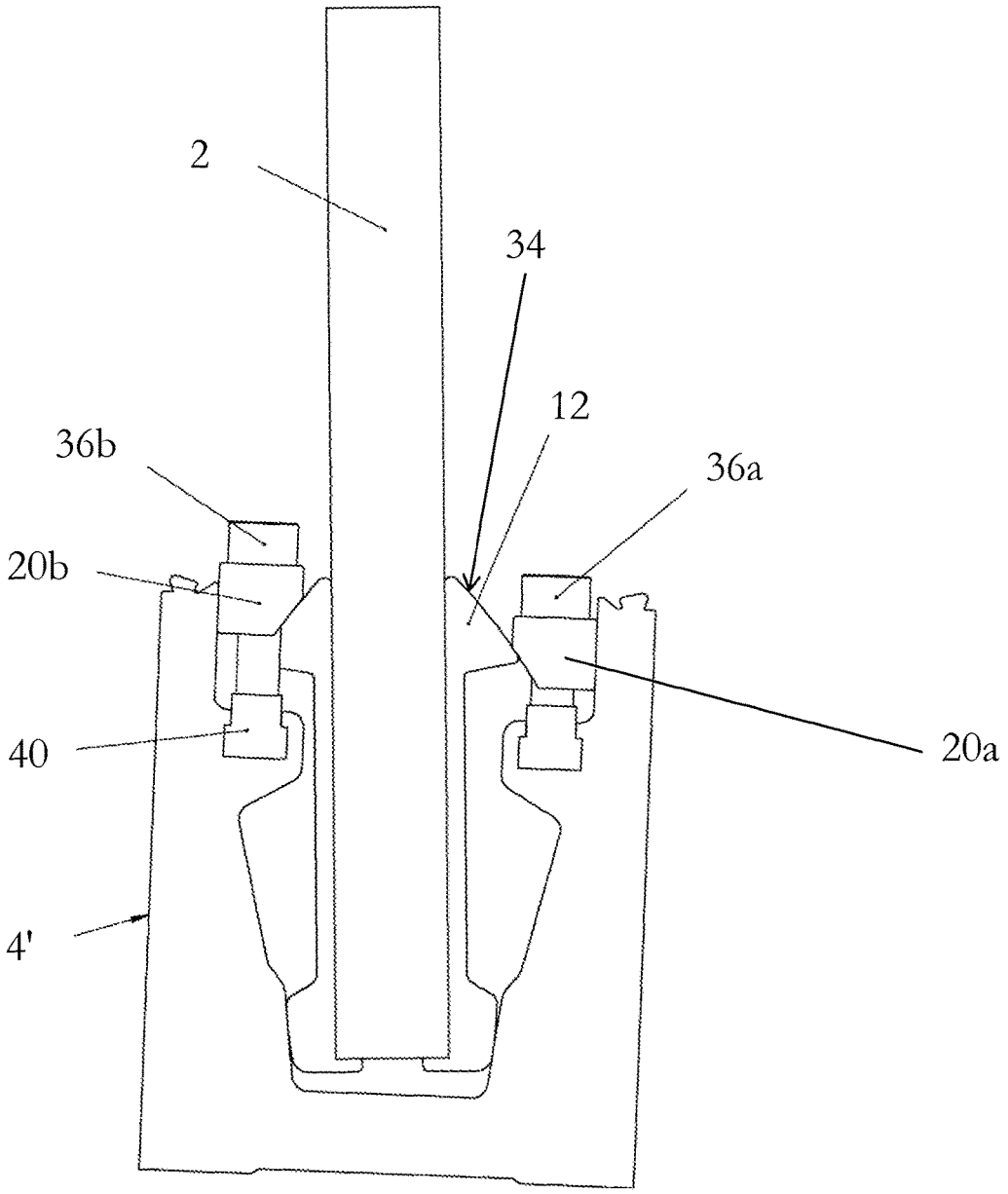
FIG. 7 shows an end view of the second arrangement in a second configuration.

FIG. 7 shows an end view of the second arrangement in a second configuration; that is, with the trough 4' located on a substantially non-horizontal surface (not shown) such that asymmetric adjustment of the adjustment mechanisms is required in order to align the panel 2 vertically.

The threaded shaft on the right hand side 36*a* has been tightened more than the threaded shaft on the left hand side 36*b*, such that the block on the right hand side 20*a* is lower than the block on the left hand side 20*b*. This asymmetric distribution of the blocks 20 results in an asymmetric positioning of the surfaces 34 against which the blocks 20 push.

As can be seen from the figure, the screw drives on the threaded shafts 36 are fully accessible to a user such that either may be operated without hindrance.

The invention claimed is:

1. A system for adjusting alignment of a flat panel, the system comprising:

a longitudinal trough having a left side wall and a right side wall opposing the left side wall and a base connected therebetween, the trough being open on a side opposing the base, the trough configured to be attachable to a surface;

a left gripping part for securely holding a section of the flat panel, the left gripping part having a substantially planar left contact surface for engaging with a left face of the flat panel and a first left joint surface inclined obliquely to the left contact surface, the left gripping part locatable within the longitudinal trough with the first left joint surface at least partially facing the open side of the trough opposing the base and at least partially facing the left side wall;

a left adjustment part connected at a left fixed end to the left side wall of the trough at a point between the base and the first left joint surface by means selected from the group comprising: cooperating hooking parts; screw-threading parts; gluing; welding; integrally forming the left adjustment part with the left side wall; and slidably received the left adjustment part in a left slot in the left side wall, where the left slot extends in a direction substantially parallel to a longitudinal axis of the trough, the left adjustment part having a second left joint surface spaced from the left fixed end of the left adjustment part by a left distance that is adjustable by a user, the second left joint surface arranged to face at least partially toward the left fixed end of the adjustment part and at least partially toward the base, the second left joint surface arrangable in contact with the first left joint surface to form a left planar joint with one rotational and two translational degrees of freedom, the left side wall and the second left joint surface each arranged to pull in opposing directions on the left adjustment part, away from a middle of the left adjustment part such that the left adjustment part is under tension; and a right gripping part for securely holding a section of the flat panel, the right gripping part having a substantially planar right contact surface for engaging with a right face of the flat panel and a first right joint surface inclined obliquely to the right contact surface, the right gripping part locatable within the longitudinal trough with the first right joint surface at least partially facing the open side of the trough opposing the base and at least partially facing the right side wall; and a right adjustment part connected at a right fixed end to the right side wall of the trough at a point between the base and the first right joint surface by means selected from the further group comprising: cooperating hooking parts; screw-threading parts; gluing; welding; integrally forming the right adjustment part with the right side wall; and slidably received the right adjustment part in a right slot in the right side wall, where the right slot extends in a direction substantially parallel to the longitudinal axis of the trough, the right adjustment part having a second right joint surface spaced from the right fixed end of the right adjustment part by a right distance that is adjustable by a user, the second right joint surface arranged to face at least partially toward the right fixed end of the adjustment part and at least partially toward the base, the second right joint surface arrangable in contact with the first right joint surface to form a right planar joint with one rotational and two translational degrees of freedom, the right side wall and the second right joint surface each arranged to pull in opposing directions on the right adjustment part, away from a middle of the right adjustment part such that the right adjustment part is under tension; and the system configured such that mutually increasing the distance between the second left joint surface and the left fixed end of the left adjustment part, and reducing the distance between the second right joint surface and the right fixed end of the right adjustment part results in:

a decrease in a force being applied by the second left joint surface onto the first left joint surface, resulting in decreased gripping of the left gripping part on the panel and decreased urging of the panel toward the base of the trough;

an increase in a force being applied by the second right joint surface onto the first right joint surface, resulting in increased gripping of the right gripping part on the panel and increased urging of the panel toward the base of the trough; and pivoting of the panel within the trough about an axis parallel to a longitudinal length of the trough toward the left side wall, while the panel is being securely held, to achieve adjustment of alignment of the panel.

2. The system of claim 1, configured such that, when in use, the left and right adjustment parts are under tension.

3. The system of claim 1, wherein the first left joint surface and the first right joint surface is each orientated at an angle of between 20 and 70 degrees to the respective left and right contact surface, measured about an axis that is substantially parallel to the longitudinal length of the trough.

4. The system of claim 1, wherein at least one joint surface selected from the first left joint surface, the first right joint surface, the second left joint surface and the second right joint surface has a substantially lower coefficient of friction than at least one contact surface selected from the left contact surface and the right contact surface.

5. The system of claim 1, wherein the left adjustment part is secured to the left side wall of the trough at the left fixed end by a left cooperating engaging mechanism, and the right adjustment part is secured to the right side wall of the trough at the right fixed end by a right cooperating engaging mechanism.

6. The system of claim 1, wherein the left adjustment part comprises:

an externally threaded shank having a head;

a sliding part arranged to be slidably receivable on the threaded shank, the sliding part comprising the second left joint surface; and an internally threaded nut; and wherein the sliding part is biased away from the left fixed end by the first left joint surface, and relative rotation of the nut and the head about an axis of the shank causes movement of the sliding part with respect to the left fixed end.

7. The system of claim 6, wherein the head is located at the left fixed end such that rotation of the nut moves the sliding part along the threaded shank.

8. The system of claim 6, wherein the nut is located at the left fixed end such that rotation of the head moves the sliding part with the head in relation to the left fixed end.

9. A method of adjusting alignment of a flat panel, the method comprising:

providing a flat panel;

providing a system according to claim 1;

attaching the trough to a surface;

engaging at least one of the left and right contact surfaces of at least one of the left and right gripping parts with a face of the flat panel;

securely holding a section of the flat panel with the at least one of the left and right gripping parts;

locating the at least one of the left and right gripping parts within the longitudinal trough with at least one of the left and right first joint surfaces at least partially facing the open side of the trough opposing the base;

connecting at least one of the left and right adjustment parts at a respective fixed end to one of the side walls of the trough;

arranging at least one of the left and right second joint surfaces in contact with the at the least one of the left and right first joint surfaces to form a joint;

reducing at least one of the left and right distances between the at least one of the left and right second joint surfaces and at least one of the left and right fixed ends of the at least one of the left and right adjustment parts;

applying a force with the at least one of the left and right second joint surfaces onto the at least one of the left and right first joint surfaces;

gripping the panel with the at least one of the left and right gripping parts;

urging the panel with the at least one of the left and right gripping parts toward the base of the trough; and pivoting of the panel within the trough about an axis parallel to a longitudinal length of the trough.

* * * * *